US005499591A

United States Patent [19]

Chippas

[11] Patent Number: 5,499,591

[45] Date of Patent: Mar. 19, 1996

[54] MOORING DEVICE FOR BOATS

[76] Inventor: Laura L. Chippas, 1450 SW. 10th St., Bay #2, Delray Beach, Fla. 33444

[21] Appl. No.: 389,411

[22] Filed: Feb. 16, 1995

[51] Int. Cl.[6] ..... B63H 21/00

[52] U.S. Cl. ..... 114/230; 114/218; 114/250

[58] Field of Search ..... 114/250, 218, 114/230; 280/491.2, 491.1, 494

[56] References Cited

U.S. PATENT DOCUMENTS

| | | | |
|---|---|---|---|
| 2,497,234 | 2/1950 | Mylie | 280/494 |
| 2,983,243 | 5/1961 | Bowers et al. . | |
| 3,108,563 | 10/1963 | Wurdack . | |
| 3,157,150 | 11/1964 | Faber, Jr. . | |
| 3,177,838 | 4/1965 | Grimes . | |
| 3,406,651 | 1/1968 | Jalbert . | |
| 3,659,545 | 5/1972 | Hedman . | |
| 3,861,731 | 1/1975 | Young . | |
| 3,993,013 | 11/1976 | Nunziato et al. . | |
| 4,193,368 | 3/1980 | DeGraaf et al. . | |
| 4,250,827 | 2/1981 | Booker et al. . | |
| 4,686,926 | 8/1987 | Vance . | |
| 4,708,083 | 11/1987 | Billings . | |
| 4,817,551 | 4/1989 | Matson . | |
| 4,932,700 | 6/1990 | Hart . | |
| 5,014,638 | 5/1991 | Ilves et al. . | |
| 5,243,926 | 9/1993 | Wright et al. . | |

FOREIGN PATENT DOCUMENTS

| | | | |
|---|---|---|---|
| 2619830 | 11/1977 | Germany | 280/491.2 |
| 3802726 | 8/1989 | Germany | 280/491.1 |

*Primary Examiner*—Sherman Basinger
*Attorney, Agent, or Firm*—Popham, Haik, Schnobrich & Kaufman, Ltd.

[57] ABSTRACT

A mooring device for boats comprising an elongate arm having first and second ends. The arm has a transverse slot therein adjacent the first end, and dimensioned to received a cleat. The slot is in effect a fixed hook which opens to the side of the arm. A rotatable is mounted to the second end of the arm for rotation about an axis parallel to the longitudinal axis of the arm. The hook is rotatable between a closed position in which its free leg opposes the second end of the arm and an open position in which its free leg is spaced from the second end. In the closed position, the hook lies in a plane perpendicular to the plane of the slot. The hook is dimensioned to engage a cleat. A locking mechanism such as a sliding bolt is provided for locking a cleat in the slot. The arm can be telescopic, or provided with hinges which are pivotable in opposite directions, so that it can be adjusted for boarding and deboarding. Alternatively, the mooring device can further include rotatable cleats, which enable the arm to be oriented perpendicular to the boat side for docking and to be oriented at a severely acute angle to the boat side for boarding and deboarding.

13 Claims, 5 Drawing Sheets

MOORING DEVICE FOR BOATS

BACKGROUND OF THE INVENTION

1. Field of the Invention

The present invention relates to a mooring device for boats. More specifically, the invention relates to a mooring device which can be used to secure a boat to a dock or to another boat, and which can be locked in place.

2. Related Art

Numerous devices are known for use in mooring and handling boats. These devices commonly use some kind of hook or cleat to attach to the boat. For example, U.S. Pat. No. 3,861,731 to Young discloses a boat handler having a hook element 18 which can be rotated to close it on an anvil piece 14 so that it captures a cleat 24 on a boat.

U.S. Pat. No. 3,108,563 to Wurdack discloses a mooring boom for attaching a boat to a wharf or the like. The boom is secured to the boat by a mooring clamp 64 adapted to be connected to a mooring bracket 34. The clamp 64 is formed of two half rings 66 and 68 which are locked together by a pin 70 (see FIG. 9). The clamp ring 66 is pivoted to a bifurcated swivel 72 connected to the end of the boom to provide a universal connection.

U.S. Pat. No. 3,406,651 to Jalbert discloses a mooring means including a pivoting hook 25 for securing a boat to a dock.

U.S. Pat. No. 2,983,243 to Bowers et al. and U.S. Pat. No. 4,932,700 to Hart disclose remotely operated shackles (16 and 20, respectively) for use in mooring a boat.

U.S. Pat. No. 3,659,545 to Hedman, U.S. Pat. No. 4,193,368 to DeGraaf et al., and U.S. Pat. No. 5,014,638 to Ilves et al. disclose mooring devices which are pivotally attached to a stationary structure.

U.S. Pat. No. 3,993,013 to Nunziato et al. discloses a telescopic mooring pole.

U.S. Pat. No. 4,708,083 to Billings and U.S. Pat. No. 4,817,551 to Matson discloses mooring devices comprising a rigid tubular sleeve, attaching members at the ends of the sleeve, an elastic member attached to the attaching members and passing through the sleeve.

U.S. Pat. No. 5,243,926 to Wright et al. discloses a mooring device including a telescoping arm attached to a dock at one end and a boat at the other end by pivoting brackets. The bracket at the boat end incorporates a sliding, locking mechanism (see FIG. 2). U.S. Pat. Nos. 4,250,827 to Booker et al., U.S. Pat. No. 3,177,838 to Grimes, and U.S. Pat. No. 3,157,150 to Faber, Jr. also disclose mooring arms with a telescoping structure; and that the patents to Wright et al., Grimes, and Faber, Jr., and U.S. Pat. No. 4,686,926 to Vance disclose mooring arms incorporating one or more hinges.

Many of these devices, such as those of Wurdack, Hedman, Ilves et al., De Graaf et al., Booker et al., Hart et al., Grimes, Tortorici, Vance, and Faber, are intended for permanent or semi-permanent attachment either to the boat or the dock. Also, many of these devices, such as those of Wurdack, Hedman, Matson, DeGraaf et al., Hart et al., Tortorici, Vance, and Faber, do not permit movement of the boat between a docking position and a boarding position. Still others, such as those of Young, and Nunziato et al., can be used to handle a boat but not to moor it. Further, the prior art devices do not provide for locking both at the dock end and the boat end. Some, such as those of Billings and Matson, do not even provide for a lock at one end. It is to the solution of these and other problems to which the present invention is directed.

SUMMARY OF THE INVENTION

It is therefore a primary object of the invention to provide a mooring device for boats which is fully removable, and which can be used to secure a boat to a dock or another boat using the conventional cleats provided on docks and boats.

It is another object of the invention to provide a mooring device for boats which can be used to maintain a boat a given distance from a dock.

It is still another object of the invention to provide a mooring device for boats which can be used to lock and secure a boat while docked.

It is still another object of the invention to provide a mooring device for boats which can be used for boat to boat docking.

It is yet another object of the invention to provide a mooring device for boats which can be used to connect two boats stern to bow for towing.

These and other objects of the invention are achieved by the provision of a mooring device for boats comprising an elongate arm having first and second ends and a longitudinal axis. The arm has a slot therein adjacent the first end, the slot extending transversely in a plane perpendicular to the longitudinal axis. The slot is dimensioned to received a cleat therein. The slot is in effect a fixed hook which opens to the side of the arm.

A hook having a free leg and an attached leg is rotatably mounted by its attached leg to the second end of the arm for rotation about an axis parallel to the longitudinal axis of the arm. The hook is rotatable between a closed position in which the free leg opposes the second end of the arm and an open position in which the free leg is spaced from the second end. In the closed position, the hook lies in a plane perpendicular to the plane of the slot. The hook is dimensioned to engage a cleat.

A locking mechanism is provided for locking a cleat in the slot. In one aspect of the invention, the locking mechanism comprises a bolt slidable in the arm along the longitudinal axis, into and out of engagement with the slot. The locking mechanism can also include a first eye affixed to the arm and a second eye affixed to the bolt. The second eye is positioned to align with the first eye when the bolt is in engagement with the slot, in order to receive a padlock.

In another aspect of the invention, the arm includes first and second parallel hinges inset from the first and second ends, respectively. The first and second hinges are perpendicular to the longitudinal axis and open in opposite directions, to enable the portion of the arm between the hinges to be oriented substantially parallel to the boat side for boarding and deboarding, and substantially perpendicular to the boat side for docking.

In an alternative aspect of the invention, the arm is telescopic, so that it can be extended and retracted to adjust for lower and higher tides.

In another alternative aspect of the invention, the mooring device further includes rotatable cleats, which enable the arm to be oriented perpendicular to the boat side for docking and to be oriented at a severely acute angle to the boat side for boarding and deboarding.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
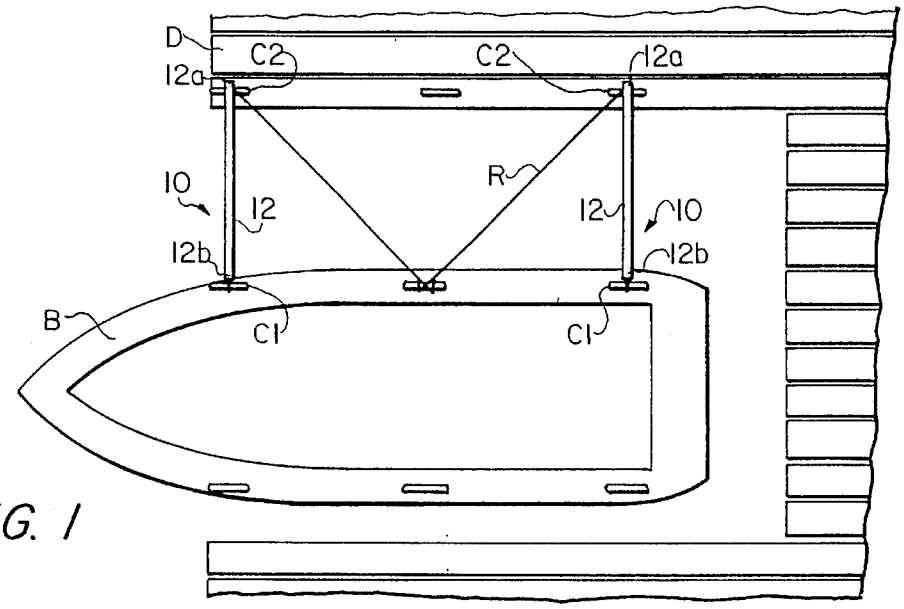
FIG. 1 is a top plan view of a boat moored at a dock using two mooring devices in accordance with a first embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIGS. 6–11, there is shown a mooring device 10 for boats in accordance with the present invention. Mooring device 10 comprises and arm 12 having first and second ends 12*a* and 12*b* and a side surface 12*c*. As illustrated in FIGS. 6–11, arm 12 is formed from a tube having a rectangular prismatic form. However, as will be described hereafter, other shapes are possible.

First end 12*a* is the end of arm 12 designed to be fastened to the boat. Arm 12 has a slot 20 therein adjacent first end 12*a*. Slot 20 extends transversely in a plane perpendicular to the longitudinal axis A of arm 12. Slot 20 is dimensioned to received a cleat C1 of such size and design as is conventionally found on boats.

As will be readily appreciated, slot 20 is in effect a fixed hook which opens to the side of arm 12.

Figure 7:
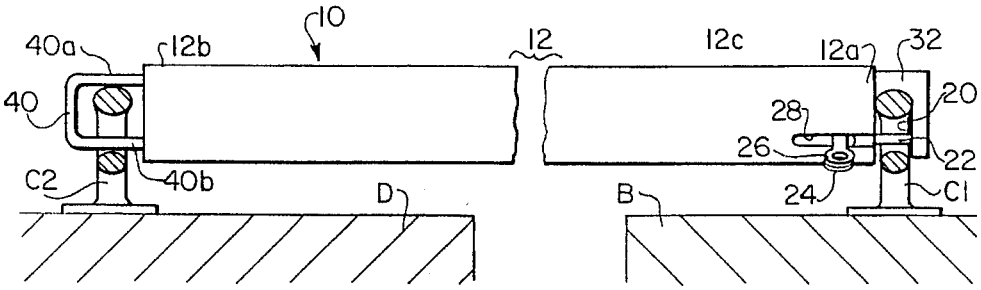
FIG. 7 is a side elevational view, partially in cross-section, of the mooring device of FIG. 7 rotated to engage the cleat of the boat.
Figure 9:
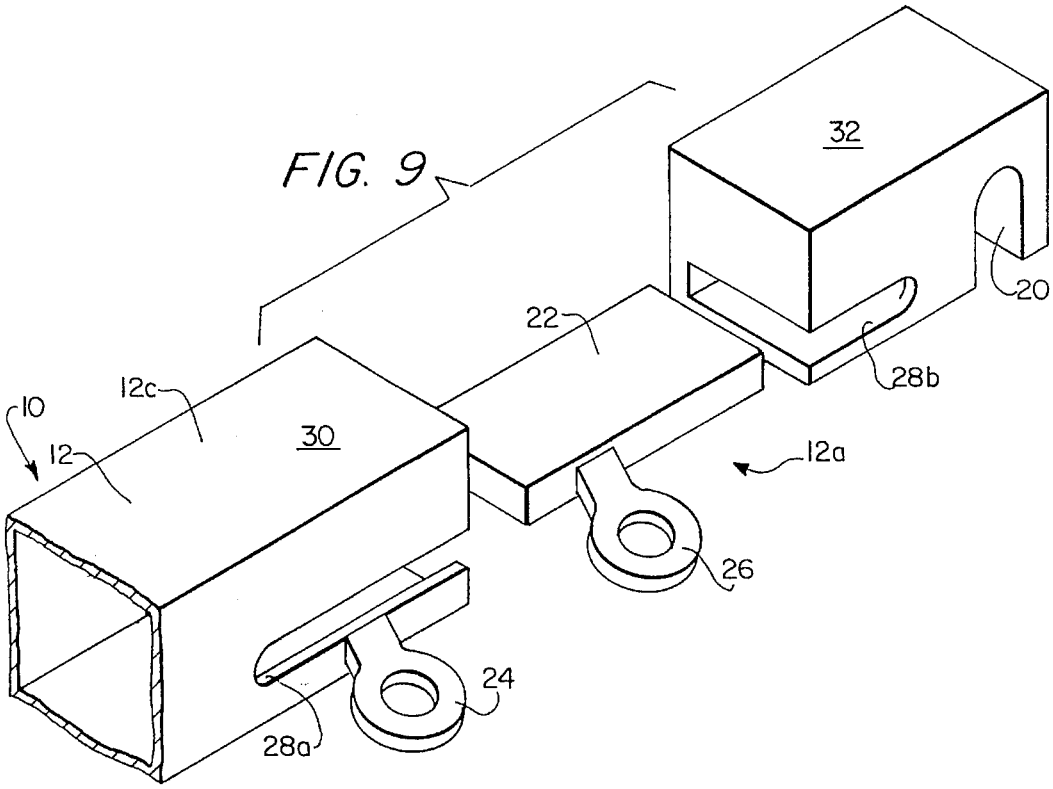
FIG. 9 is an exploded perspective view of the boat end of the mooring device of FIG. 6.
Figure 11:
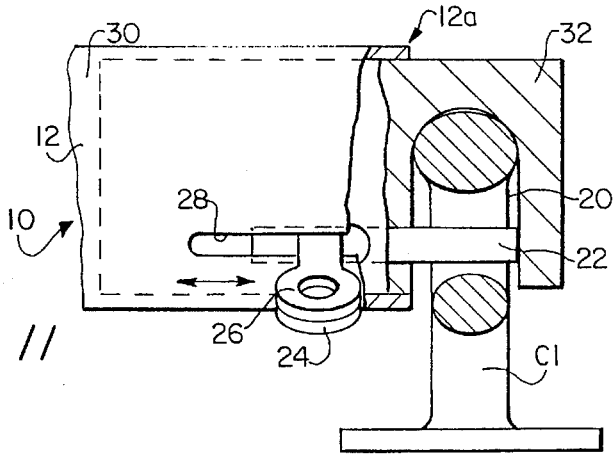
FIG. 11 is an enlarged view of the area indicated in FIG. 2 by a broken circle, and shows an assembled cross-sectional view of the boat end of the mooring device as shown in FIG. 9.

In order to prevent accidental or unauthorized removal of arm 12 from the boat B, means are provided for locking the cleat C1 in slot 20. As shown in FIGS. 7, 9, and 11, the locking means can comprise a bolt 22 slidable in arm 12 along longitudinal axis A into and out of engagement with slot 20. A first eye 24 is affixed to arm 12 and a second eye 26 is affixed to bolt 22 through a longitudinal slot 28 provided in side surface 12*c* of arm 12. Second eye 26 is positioned to align with first eye 24 when bolt 22 is in engagement with slot 20, in order to receive a padlock.

As will be appreciated by those of skill in the art, arm 12 with slot 20 and bolt 22 can be fabricated by a variety of conventional machining methods. Referring to FIGS. 9 and 11, one method contemplated by the present invention is to form first end 12*a* in two pieces using a piece of square tubing 30 for the main body of arm 12 and a block 32 as an insert carrying bolt 22. Transverse slot 20 is formed in block 32, and longitudinal slot 28 is formed in two aligned sections 28*a* and 28*b* extending inwardly from the open ends of tubing 30 and block 32, respectively. Bolt 22 is inserted into the open end of block 32, and then block 32 is inserted into the open end of tubing 30 and welded flush.

Referring now to FIGS. 6–8 and 10, a rotatable hook 40 dimensioned to engage a cleat C2 on a dock D or a second boat is mounted on second end 12*b* of arm 12 for rotation about an axis parallel to longitudinal axis A. Second end 12*b* is planar, and hook 40 opens towards second end 12*b*. Hook 40 is rotatable 180° between an open position (in which its open side is rotated to one side of second end 12*b*) for engaging or releasing cleat C2 and a closed position (in which its open side lies flush against second end 12*b*) for retaining cleat C2. In its open and closed positions, hook 40 lies in a plane perpendicular to the plane of slot 20. Considering slot 20 as defining or being equivalent to a fixed hook, then hook 40 is oriented 90° to the fixed hook.

Figure 8:
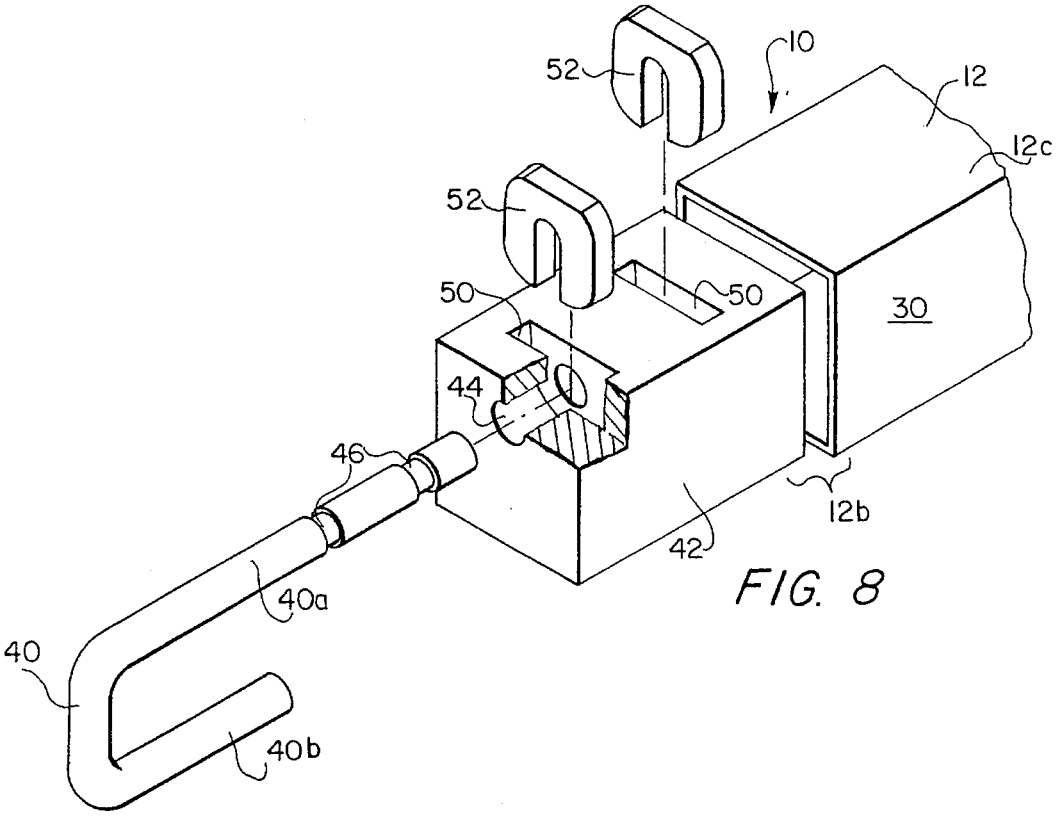
FIG. 8 is an exploded perspective view of the dock end of the mooring device of FIG. 6.
Figure 10:
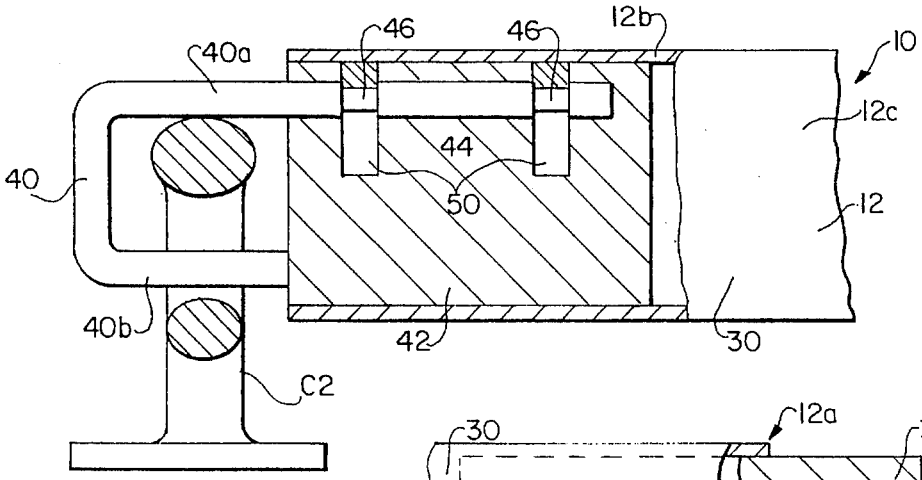
FIG. 10 is an enlarged view of the area indicated in FIG. 2 by a broken circle, and shows an assembled cross-sectional view of the dock end of the mooring device as shown in FIG. 8.

As will be appreciated by those of skill in the art, second end 12*b* of arm 12 carrying hook 40 also can be fabricated by a variety of conventional machining methods. Referring to FIGS. 8 and 10, as with first end 12*a*, second end 12*b* can be formed in two pieces, square tubing 30 forming the main body of arm 12 and a block 42 as an insert carrying hook 40. Hook 40 has a long attached leg 40*a*, which is inserted into block 42, and a short free leg 40*b* which engages second end 12*b* in the closed position. Long leg 40*a* rests in a longitudinal channel 44 formed in one side of block 42. Long leg 40*a* is formed with two necked-in portions 46, which align with a pair of slots 50 formed transversely across channel 44. Two U-shaped clips 52 fit over necked-in portions 46 and into slots 50 and are welded to hold long leg 40*a* in place in block 42. Similar to the assembly of first end 12*a*, block 42 is inserted into the open end of tubing 30 and welded flush.

Figure 4:
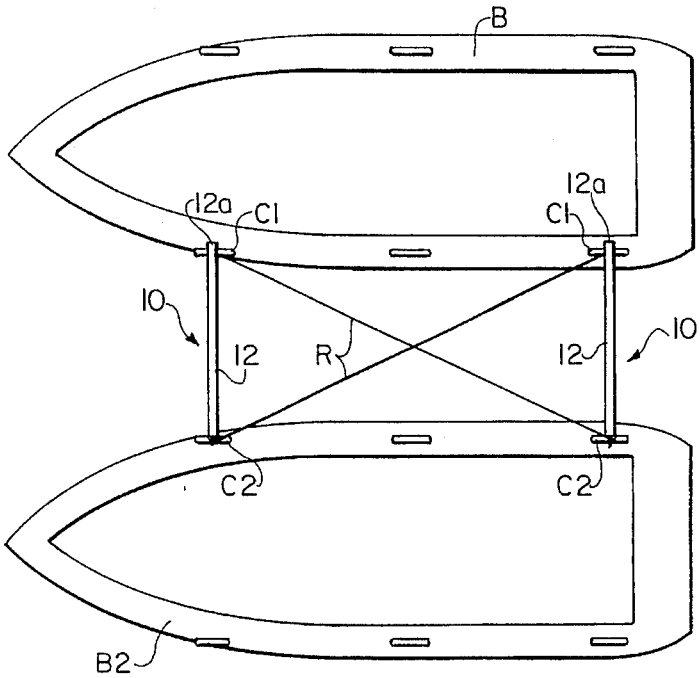
FIG. 4 is a top plan view of two boats moored to each other using two mooring devices of the type shown in FIG. 1.
Figure 6:
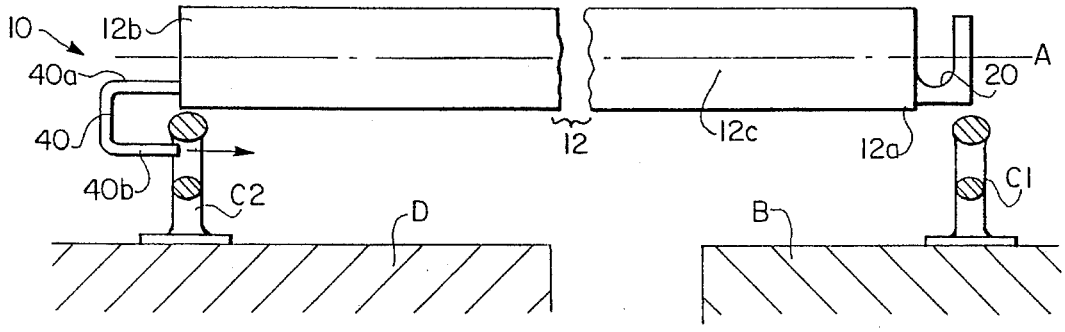
FIG. 6 is a side elevational view, partially in cross-section, of a mooring device in accordance with the present invention prior to engagement with the cleat of a boat to be moored.

In order to moor a boat B to a dock D or another boat B2, two parallel mooring devices 10 preferably are used, as shown in FIGS. 1 and 4, extending between one side of the boat B and the dock D or one side of the other boat B2. Each mooring device is installed in the same manner. Hook 40 is opened and arm 12 is oriented with slot 20 facing upwardly, as shown in FIG. 6. The free leg 40*b* of hook 40 is inserted through a cleat C2 on the dock D or other boat B2, as also shown in FIG. 6, and arm 40 is rotated 180° to close hook 40, as further shown in FIG. 7. Slot 20, now facing downwardly, is placed over the cleat C1 on the first boat B, and bolt 22 is slid into engagement with slot 20 to lock arm 12 in place, as also shown in FIG. 7. If desired, a padlock can be inserted through first and second eyes 24 and 26. Rope R can additionally be used to tie the boat B to the dock D or other boat B2, for example in a "V" as shown in FIG. 1, or in an "X" configuration as shown in FIG. 4, to further secure the boat B.

Due to the relative orientation of hook 40 to slot 20, arm 12 is locked in place on the dock D or other boat B2 once arm 12 is turned to receive the cleat C2 in slot 20. Further, once bolt 22 is secured by a padlock, arm 12 cannot be turned to release hook 40 from the cleat C2 on the dock D or other boat B2. Thus, mooring device 10 is locked at both ends, although the user only manipulates first end 12*a*.

Figure 2:
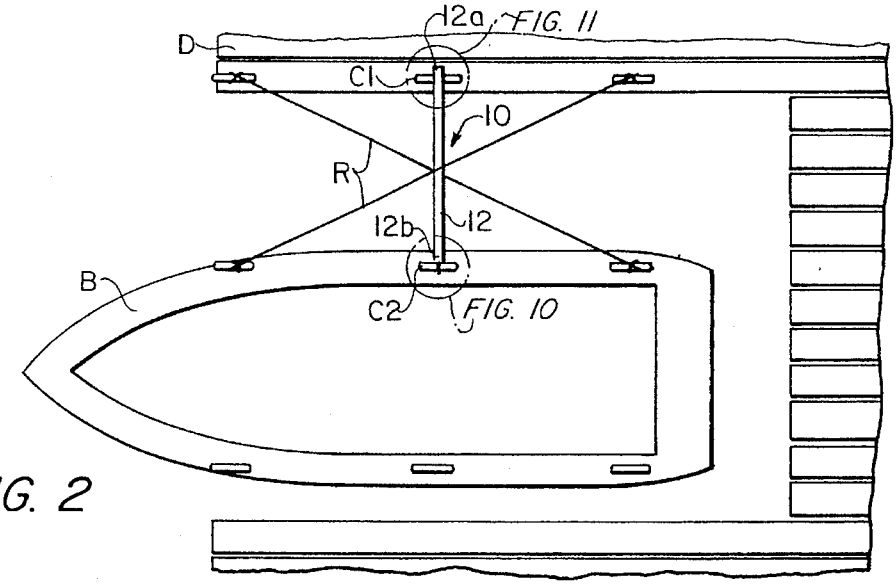
FIG. 2 is a top plan view of a boat moored at a dock using a single mooring device of the type shown in FIG. 1.

As shown in FIG. 2, a single mooring device 10 can also be used to moor a boat B to a dock D or another boat. Ropes R in an "X" configuration are used to tie the side of the boat B to the dock D or other boat, and mooring device 10 is attached as described above between the center of one side of the boat B and the dock D or other boat, so as to extend over or under the ropes R where they cross.

Figure 5:
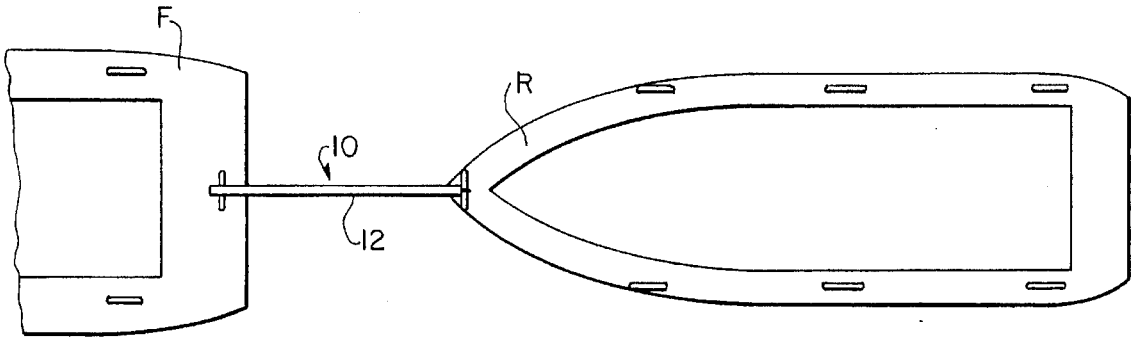
FIG. 5 is a top plan view of a first boat towing a second boat using a single mooring device of the type shown in FIG. 1.

Also, a single mooring device 10 can be attached as described above between the stern of a forward boat F and the bow of a rearward boat R, for towing, as shown in FIG. 5.

Figure 12:
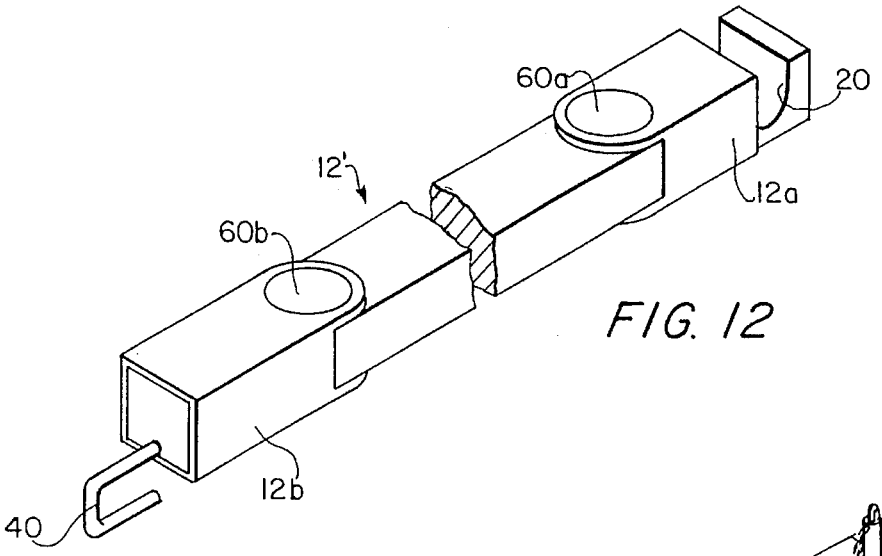
FIG. 12 is a perspective view of a mooring device incorporating hinges as shown in the area indicated in FIG. 3 by a broken circle, in accordance with a third embodiment of the invention.

Several alternative embodiments are possible to enable the boat to be maneuvered between its docked position and a boarding position. In one alternative embodiment, shown in FIGS. 3 and 12, arm 12' includes first and second parallel hinges 60*a* and 60*b* inset from the first and second ends 12*a* and 12*b*, respectively. First and second hinges 60*a* and 60*b* pivot on vertically-oriented axes perpendicular to longitudinal axis A and are pivotable in opposite directions, enabling the portion of arm 12' between first and second hinges 60*a* and 60*b* to be oriented substantially parallel to the boat side for boarding and deboarding, and substantially perpendicular to the boat side for docking.

Figure 13:
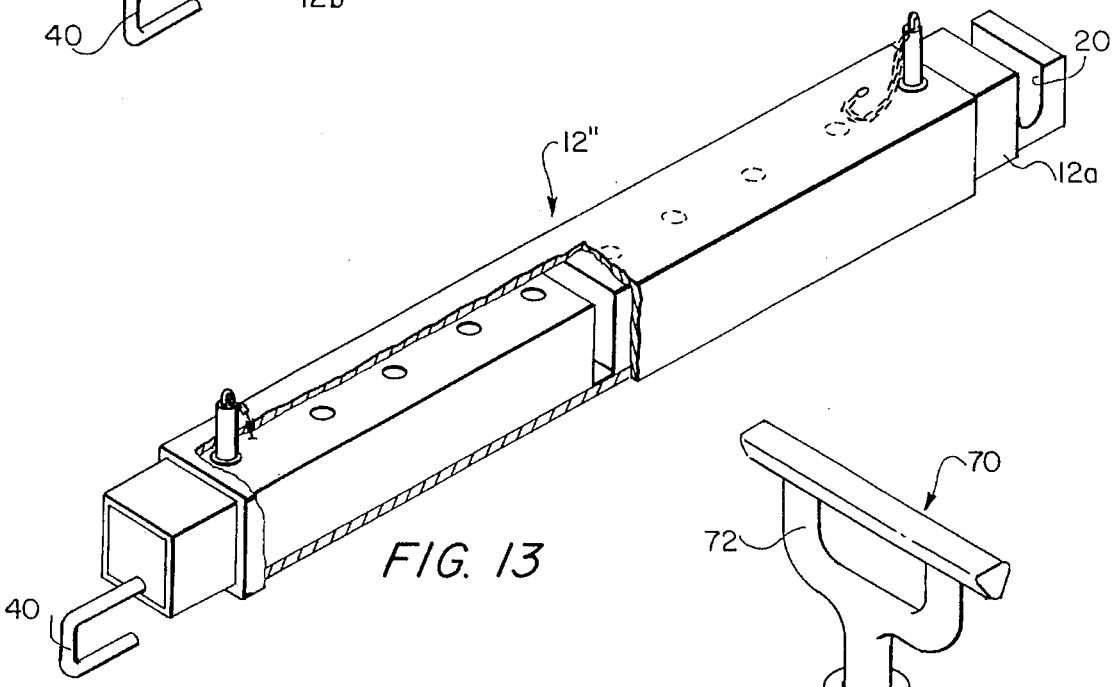
FIG. 13 is a perspective view of a mooring device incorporating a telescopic arm, in accordance with a fourth embodiment of the invention.

In another alternative embodiment, shown in FIG. 13, arm 12" is telescopic. Arm 12" can thus be extended and retracted to adjust for lower and higher tides.

Figure 3:
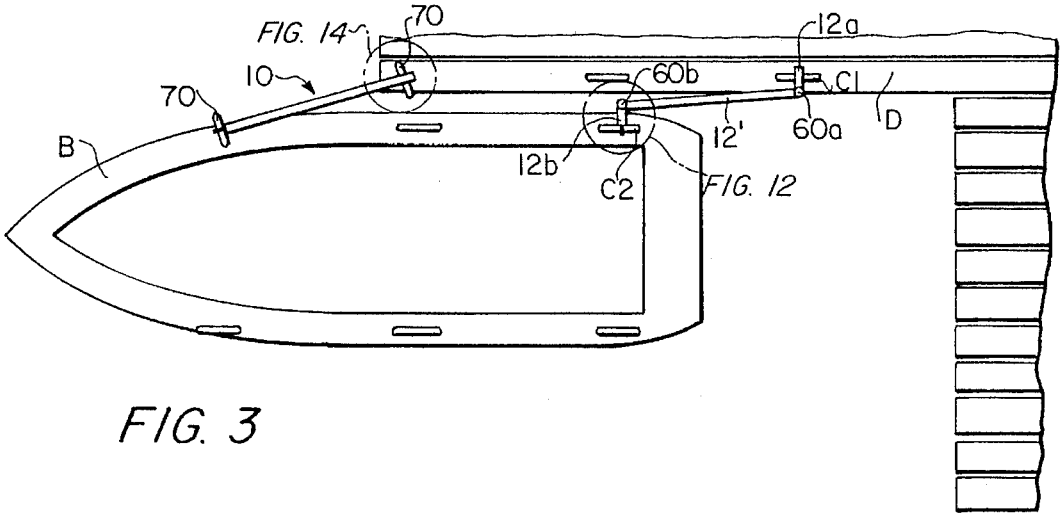
FIG. 3 is a top plan view of a boat moored at a dock using two mooring devices in accordance with a second embodiment of the present invention.
Figure 14:
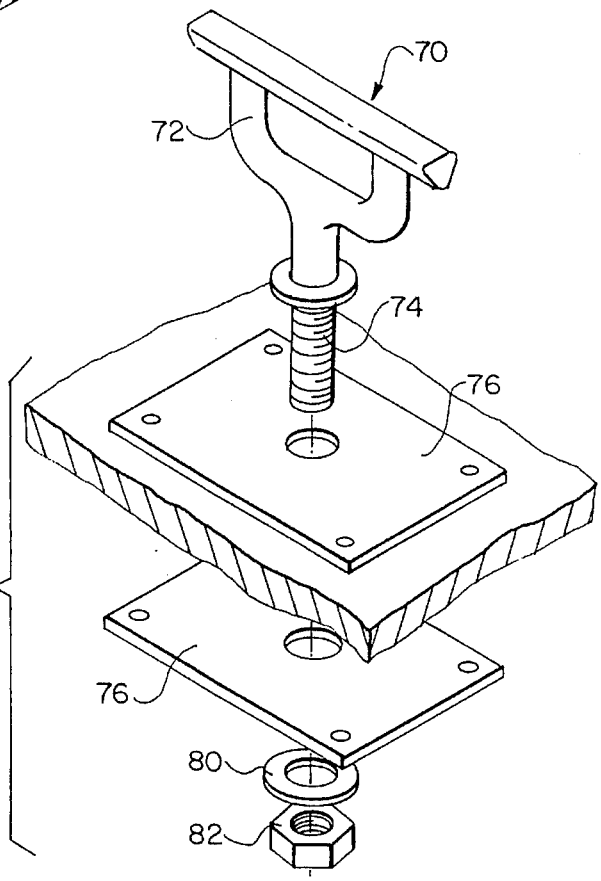
FIG. 14 is an exploded perspective view of a pivoting cleat as shown in the area indicated in FIG. 3 by a broken circle, for use in the mooring device of the present invention.

In a third alternative embodiment, shown in FIGS. 3 and 14, mooring device 10 additionally includes rotating cleats 70 installed on the boat and the dock or other boat to which it is to be moored. Rotating cleats 70 comprise the shackle portion 72 of a conventional cleat rotatably connected to a threaded shaft 74 for attachment to a boat deck or dock D. Metal plates 76 are attached above and below deck or dock D at the side of cleat 70, and threaded shaft 74 is inserted through aligned holes in metal plates 76 and deck or dock D, and secured in place by a conventional washer 80 and nut 82. Rotating cleats 70 enable arms 12 to be oriented perpendicular to the boat side for docking and to be oriented at a severely acute angle to the boat side for boarding and deboarding.

Modifications and variations of the above-described embodiments of the present invention are possible, as appreciated by those skilled in the art in light of the above teachings. For example, arm 12 need not be rectangular prismatic in form, but can have a circular cross-section.

It is therefore to be understood that, within the scope of the appended claims and their equivalents, the invention may be practiced otherwise than as specifically described.

What is claimed is:

1. A mooring device for boats comprising:

an elongate arm having a first end, a second end, and a longitudinal axis, said arm having a slot therein adjacent said first end, said slot extending transversely in a plane perpendicular to said longitudinal axis, and said slot being dimensioned to received a cleat therein;

means for locking a cleat in said slot; and a hook having a free leg and an attached leg, said hook being mounted by said attached leg to said second end of said arm for rotation about an axis parallel to said longitudinal axis of said arm, said hook being rotatable between a closed position in which said free leg opposes said second end and an open position in which said free leg is spaced from said second end, said hook in said closed position lying in a plane perpendicular to said plane of said slot, and said hook being dimensioned to engage a cleat.

2. The mooring device of claim 1, wherein said means for locking comprises a bolt slidable in said arm along said longitudinal axis into and out of engagement with said slot.

3. The mooring device of claim 2, wherein said means for locking further comprises a first eye affixed to said arm and a second eye affixed to said bolt, said second eye being positioned to align with said first eye when said bolt is in engagement with said slot, in order to receive a padlock.

4. The mooring device of claim 1, wherein said arm includes first and second parallel hinges inset from said first and second ends, respectively, said first and second hinges pivoting on vertically-oriented axes perpendicular to said longitudinal axis and being pivotable in opposite directions.

5. The mooring device of claim 1, wherein said arm is telescopic.

6. A mooring device for boats comprising:

an elongate arm having a first end, a second end, a side surface, and a longitudinal axis;

a fixed hook at said first end, said fixed hook having an opening towards said side surface of said arm, and being dimensioned to received a cleat therein;

means for locking a cleat in said fixed hook; and a rotatable hook mounted on said second end of said arm, said rotatable hook having an opening towards said second end and being rotatable about an axis parallel to said longitudinal axis of said arm between a closed position in which said opening is closed by said second end and an open position in which said opening is at least partially spaced from said second end, said rotatable hook in said closed position being oriented 90° to said fixed hook, and said rotatable hook being dimensioned to engage a cleat.

7. The mooring device of claim 6, wherein said means for locking comprises a bolt slidable in said arm along said longitudinal axis into and out-of engagement with said fixed hook.

8. The mooring device of claim 6, wherein said arm includes first and second parallel hinges inset from said first and second ends, respectively, said first and second hinges pivoting on vertically-oriented axes perpendicular to said longitudinal axis and being pivotable in opposite directions.

9. The mooring device of claim 6, wherein said arm is telescopic.

10. A mooring device for boats comprising:

first and second rotatable cleats;

an elongate arm having a first end, a second end, a side surface, and a longitudinal axis;

a fixed hook at said first end, said fixed hook having an opening towards said side surface of said arm, and being dimensioned to received said first rotatable cleat therein;

means for locking said first rotatable cleat in said fixed hook; and a rotatable hook mounted on said second end of said arm, said rotatable hook having an opening towards said second end and being rotatable about an axis parallel to said longitudinal axis of said arm between a closed position in which said opening is closed by said second end and an open position in which said opening is at least partially spaced from said second end, said rotatable hook in said closed position being oriented 90° to said fixed hook, and said rotatable hook being dimensioned to engage said second rotatable cleat.

11. The mooring device of claim 10, wherein said means for locking comprises a bolt slidable in said arm along said longitudinal axis into and out of engagement with said fixed hook.

12. The mooring device of claim 10, wherein said arm includes first and second parallel hinges inset from said first and second ends, respectively, said first and second hinges pivoting on vertically-oriented axes perpendicular to said longitudinal axis and being pivotable in opposite directions.

13. The mooring device of claim 10, wherein said arm is telescopic.

* * * * *